US009150944B2

(12) United States Patent
Harris

(10) Patent No.: US 9,150,944 B2
(45) Date of Patent: Oct. 6, 2015

(54) LOW SULFUR NICKEL-BASE SINGLE CRYSTAL SUPERALLOY WITH PPM ADDITIONS OF LANTHANUM AND YTTRIUM

(75) Inventor: Kenneth Harris, Spring Lake, MI (US)

(73) Assignee: Cannon Muskegon Corporation, Muskegon, MI (US)

( * ) Notice: Subject to any disclaimer, the term of this patent is extended or adjusted under 35 U.S.C. 154(b) by 763 days.

(21) Appl. No.: 12/851,111

(22) Filed: Aug. 5, 2010

(65) Prior Publication Data

US 2012/0034127 A1 Feb. 9, 2012

(51) Int. Cl.
*C22C 19/05* (2006.01)

(52) U.S. Cl.
CPC ..... *C22C 19/057* (2013.01)

(58) Field of Classification Search
USPC ..... 420/443; 148/428
See application file for complete search history.

(56) References Cited

U.S. PATENT DOCUMENTS

| | | | | |
|---|---|---|---|---|
| 4,643,782 | A | 2/1987 | Harris et al. | |
| 5,346,563 | A * | 9/1994 | Allen et al. | 148/675 |
| 5,443,789 | A | 8/1995 | Harris et al. | |

OTHER PUBLICATIONS

O.P. Sinha, et al., "Effect of residual elements on high performance nickel base superalloys for gas turbines and strategies for manufacture", Bull. Mater. Sci., vol. 28, No. 4, Jul. 2005, pp. 379-382.*

Harris et al., "Developments in Superalloy Castability and New Applications for Advanced Superalloys," Materials Science and Technology, Feb. 2009, vol. 25, No. 2, pp. 147-153.

Harris et al., "Improved Single Crystal Superalloy, CMSX-4® (SLS)[La+Y] and CMSX-486®," Sep. 19-23, 2004, 8 pages, Cannon-Muskegon Corporation, Muskegon, Michigan.

Broomfield et al., "Development and Turbine Engine Performance of Three Advanced Rhenium Containing Superalloys for Single Crystal and Directionally Solidified Blades and Vanes," 18 pages, ASME (IGTI) Turbo Expo '97, Orlando,Florida, USA, Jun. 1997.

Ford, D.A. et al., "Improved Performance Rhenium Containing Single Crystal Alloy Turbine Blades Utilizing PPM Levels of the Highly Reactive Elements Lanthanum and Yttrium," presented at the International Gas Turbine and Aeroengine Congress and Exhibition, Stockholm, Sweden, Jun. 2-5, 1998, 6 pages.

* cited by examiner

*Primary Examiner* — Jessee Roe
(74) *Attorney, Agent, or Firm* — Butzel Long

(57) ABSTRACT

A single crystal casting having substantially improved high-temperature oxidation resistance, hot corrosion (sulfidation) resistance, and resistance to creep under high temperature and high stress is characterized by an as-cast composition comprising a maximum sulfur content of 0.5 ppm by weight, a maximum phosphorus content of 20 ppm by weight, a maximum nitrogen content of 3 ppm by weight, a maximum oxygen content of 3 ppm by weight, and a combined yttrium and lanthanum content of 5-80 pm by weight. It has been discovered that careful control of the deleterious impurities, particularly sulfur, phosphorus, nitrogen and oxygen, in combination with a carefully controlled addition of yttrium and/or lanthanum provides unexpected improvements in corrosion and oxidation resistance, while also enhancing high-temperature, high-stress resistance to creep, without any detrimental effects on other mechanical properties, processing or producability, particularly castability.

5 Claims, 6 Drawing Sheets

CMSX-4 (STANDARD) - René N5
329 CYCLES AT 900° C

IMPROVED CMSX-4 SLS (La+Y)
244 CYCLES AT 900° C

P Ka1

S Ka1

Y La1

La La1

LOW SULFUR NICKEL-BASE SINGLE CRYSTAL SUPERALLOY WITH PPM ADDITIONS OF LANTHANUM AND YTTRIUM

FIELD OF THE INVENTION

This invention relates to the field of metallurgy and, more particularly, to the field of high temperature nickel-based superalloys.

BACKGROUND OF THE INVENTION

Components cast from nickel-based superalloys are known to exhibit excellent mechanical tensile, fatigue strength and creep resistance at high temperatures. Such components are also required to exhibit good surface stability, and particularly oxidation and corrosion resistance. Nickel-based superalloys are employed in the casting of jet engine turbine blades and vanes for commercial and military aircraft. They are also employed in gas turbines used for utility, industrial and marine power generation.

Over the past thirty five years, the high temperature performance capability of cast superalloys has been improved very substantially due to the development of directionally solidified and single crystal casting technology and alloys such as those manufactured by Cannon Muskegon Corporation under the designation CMSX-4® and those alloys developed by GE (René N-5 alloy) and PWA (PWA 1484 alloy).

Single crystal (SX) CMSX-4® alloy castings have a 70% volume fraction of fine gamma prime (γ') precipitate strengthening phase after very high temperature heat treatment solutioning, without incipient melting. Such casting components exhibit exceptional resistance to creep under high temperature and stress, particularly in that part of the creep-rupture curve representing one percent or less elongation, while also providing good oxidation resistance. The CMSX-4® alloys, described in U.S. Pat. Nos. 4,643,782 and 5,443,789, generally represent the state of the art. CMSX-4® alloy has been successfully used in numerous aviation and industrial and marine gas turbine applications since 1991. Close to ten million pounds (1300 heats) of CMSX-4® have been manufactured to date with total turbine engine experience of over 120 million hours. An improved version of CMSX-4®, which is pre-alloyed with lanthanum and yttrium and consists of low sulfur content of about 1 ppm (by weight), has good alloy cleanliness in terms of stable oxide inclusions, as represented by 1-2 ppm oxygen content over multiple heats. Rare earth element additions, such as lanthanum and yttrium have been beneficial to alloy oxidation performance by tying up deleterious sulfur (S) and phosphorus (P) as very stable sulphide and phosphide phases. Improvement in bare alloy oxidation behavior to minimize blade tip degradation and improve thermal barrier coating (TBC) adherence is of particular interest. The addition of rare earth elements dramatically improves the dynamic cyclic oxidation behavior of CMSX-4®. An example of the benefits of adding lanthanum (La) and yttrium (Y) can be observed in the surface microstructure following creep-rupture testing at elevated temperature (e.g., 1050° C.). After 1389 hours of testing at 1050° C., no evidence of gamma prime depletion was observed, whereas without lanthanum and yttrium addition, significant gamma prime depletion would have been expected due to the diffusion of aluminum to the alloy surface to reform the alumina scale layer due to oxide scale spallation, principally resulting from S in the alloy. This improvement translates to a substantial increase in useful component life. Studies have shown that La+Y additions to CMSX-4® alloy give the best oxidation results compared to Y or La alone (FIG. 2).

The objectives for CMSX-4® were to provide sufficient creep-rupture and oxidation resistance while also exhibiting a heat treatment temperature range which permits heat treatment at a temperature at which all of the primary gamma prime phase goes into solution without the alloy reaching its incipient melting temperature. These improvements were achieved primarily by partial replacement of tungsten (W) with rhenium (Re), lowering of chromium (Cr) to accommodate the increased alloying with acceptable phase stability, and increasing tantalum (Ta). These modifications achieved the desired improvement in creep-resistance relative to known nickel-based superalloys (CMSX-3®) without excessively narrowing the heat treatment window (the difference between the temperature at which the primary gamma prime phase goes into solution and the temperature at which incipient melting occurs) and without introducing microstructural instability, thereby facilitating economical production of high performance castings for aviation and industrial gas turbine applications. Re dramatically slows down element diffusion at high temperatures.

Although the CMSX-4® alloy has been extremely successful commercially, providing improved performance, service life and economy, single crystal nickel-based superalloy castings capable of operating at even higher temperatures and providing even longer service life are desirable.

SUMMARY OF THE INVENTION

The alloy of the present invention is a further improved nickel-based superalloy that can be single crystal cast to provide components exhibiting substantially and unexpectedly improved high-temperature oxidation resistance, hot corrosion (sulfidation) resistance, and resistance to creep under high temperature and under high stress.

The improved nickel-based single crystal superalloy of this invention are characterized by having an as-cast composition comprising a maximum sulfur content of 0.5 ppm (by weight), a maximum phosphorus content of 20 ppm (by weight), a maximum residual nitrogen content of 3 ppm (by weight), a maximum residual oxygen content of 3 ppm (by weight), and a combined yttrium and lanthanum content of 5-80 ppm (by weight). The alloy of this invention is otherwise substantially the same as the previously commercially available CMSX-4®, with the exception of minor changes in the tolerance levels for the trace impurities carbon (C) and zirconium (Zr), which are specified herein.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
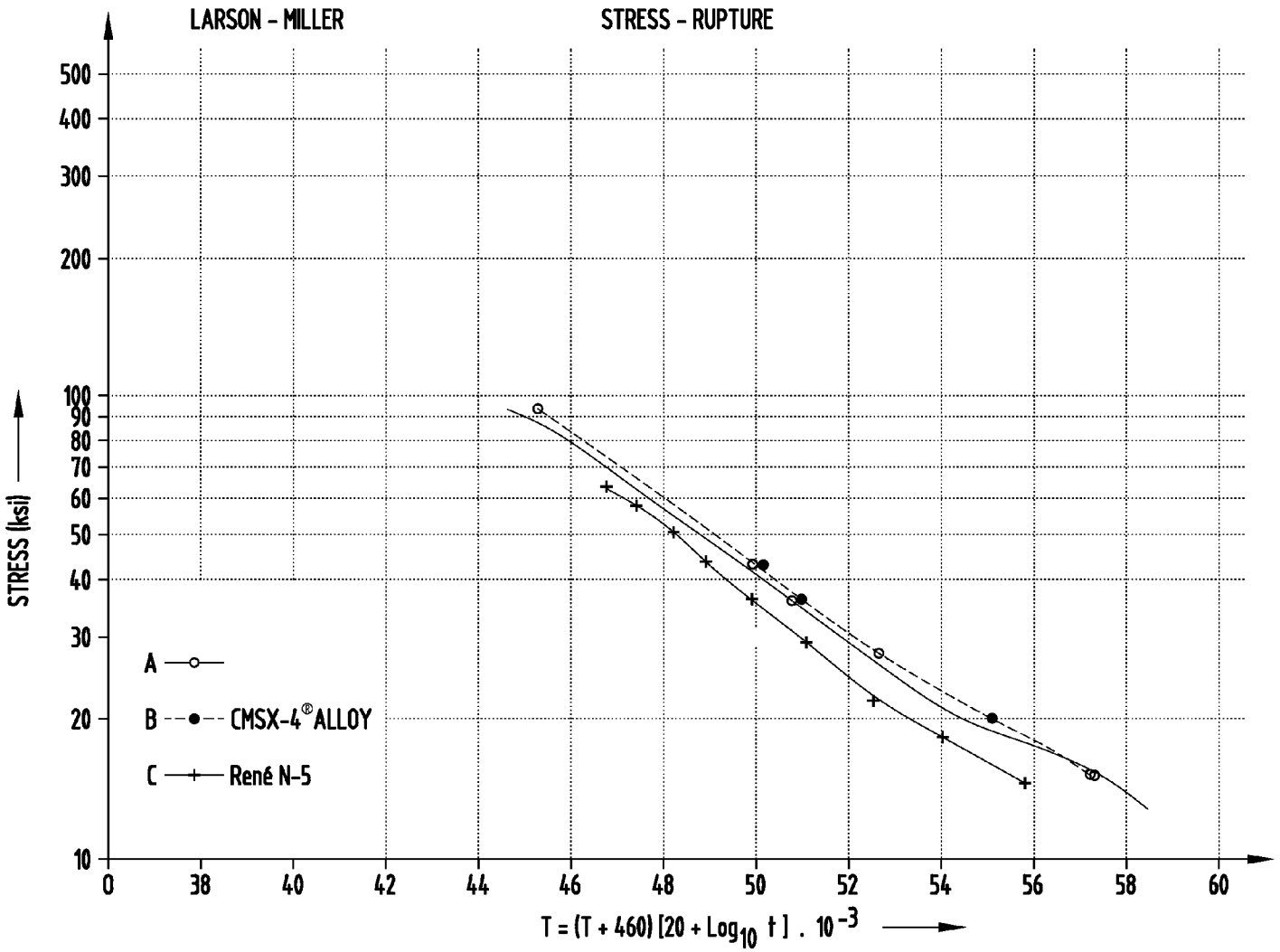
FIG. 1 is a graph of comparative Larson-Miller stress-rupture tests on alloys of the invention and on the competitive René N-5 alloy, which is generally recognized in the industry as a product competing with Cannon Muskegon's CMSX-4® alloy.

The single crystal castings of this invention surprisingly exhibit further improved oxidation resistance while also unexpectedly exhibiting an improved resistance to hot corrosion (sulfidation). More specifically, it has been found that by carefully limiting and controlling the impurity levels of sulfur and phosphorus (sulfur to a particularly low 0.5 ppm max level), in conjunction with the addition of trace amounts (ppms) of yttrium and lanthanum sufficient to scavenge remnant sulfur and phosphorus, a dramatic improvement in oxidation resistance is achieved as compared with a conventional CMSX-4® alloy, and is comparable to the oxidation resistance of René N-5 nickel-based super alloy for single crystal castings. At the same time, the invention achieves a significant improvement in high temperature creep properties relative to a René N-5 single crystal casting, suggesting that a gas turbine component casting made in accordance with this invention can be operated at a substantially higher temperature (50° F.) while providing oxidation resistance comparable to the René N-5 casting, with improved sulfidation resistance. This is turn implies that very substantial improvements in fuel efficiency and component life can be achieved. The combination of improved oxidation resistance (including equivalence to the benchmark highly oxidation resistant René N-5 alloy) and hot corrosion resistance was entirely unexpected, and the degree of improvement is not believed to be predictable from the published literature. René N-5 alloy does not contain Titanium (Ti) which contributes to its benchmark excellent oxidation resistance, since Ti is known to diffuse at high temperatures to the α alumina scale, this contamination leading to scale spallation/oxidation. The published nominal chemistry of René N-5 is shown in the following table (1).

TABLE (1)

| René N-5 (wt %/ppm) (Nominal) | |
|---|---|
| Co | 7.5 |
| Cr | 7.0 |
| Mo | 1.5 |
| W | 5.0 |
| Ta | 6.5 |
| Al | 6.2 |
| Ti | .05 max |
| Hf | .15 |
| Re | 3.0 |
| Ni | BAL |
| S | 1.0 ppm max |
| Y | 50 ppm |
| P | .005 max |
| [N] | 15 ppm max |
| [O] | 20 ppm max |
| C | .05 |
| B | .004 |
| Zr | 200 ppm max |
| Si | .20 max |
| Fe | .2 max |

The equivalence of the further improved CMSX-4®, designated CMSX-4® (SLS) [La+Y] to the oxidation performance of René N-5 is quite unexpected, since CMSX-4® contains 1.0% Ti (Table 1). The 1.0% Ti in CMSX-4® provides improved creep-rupture performance over RenéN-5 due to the role in providing a more favorable γ/γ' mismatch and interfacial chemistry.

A single crystal casting of a nickel-based superalloy composition in accordance with the invention has a composition as listed (wt %/ppm) in the following table 2.

TABLE 2

| (CMSX-4 ® (SLS) [La + Y]) | |
|---|---|
| Co | 9.3-10.0 |
| Cr | 6.2-6.6 |
| Mo | 0.5-0.7 |
| W | 6.2-6.6 |
| Ta | 6.3-6.7 |
| Al | 5.45-5.75 |
| Ti | 0.8-1.2 |
| Hf | 0.07-0.12 |
| Re | 2.8-3.2 |
| Ni | BAL |
| S | 0.5 ppm max |
| P | 20 ppm max |
| Y + La | 5-80 ppm |
| [N] | 3 ppm max |
| [O] | 3 ppm max |
| C | 100 ppm max |
| B | 25 ppm max |
| Zr | 120 ppm max |
| Si | 400 ppm max |
| Fe | 0.15 max |

Figure 2:
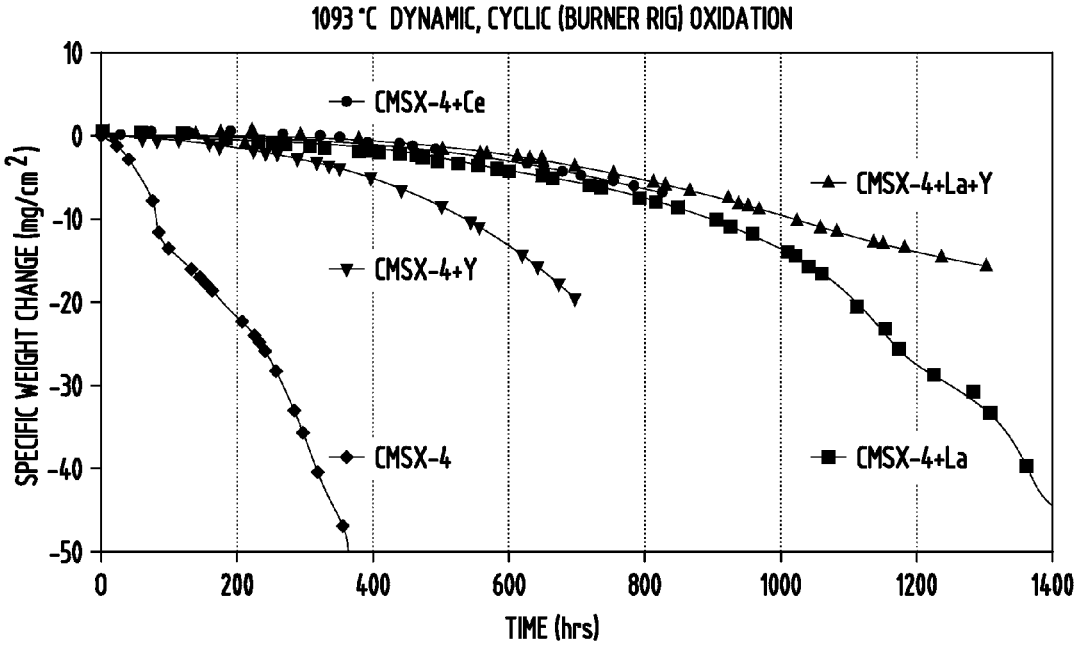
FIG. 2 is a graph comparing dynamic cyclic oxidation test results at 1093° C. (2000° F.) for various nickel-based superalloy having substantially the same composition except for the addition of trace amounts of cesium, lanthanum, yttrium, or both lanthanum and yttrium.

The graph of specific weight change versus time in FIG. 2 shows that a specimen machined from a casting of a conventional "CMSX-4®" alloy that contains lanthanum and yttrium additions in accordance with the amounts of the invention exhibits substantially less weight loss during dynamic cyclic oxidation testing at 1093° C. (2000° F.) than a similar specimen prepared from an alloy (CMSX-4®) without the addition of any reactive elements (lanthanum, yttrium, or cesium), another similar specimen prepared from an alloy (CMSX-4®+Y) containing a stoichiometrically equivalent amount of only yttrium and another similar specimen prepared from an alloy (CMSX-4®+La) containing a stoichiometrically equivalent amount of only lanthanum. These results show that the addition of lanthanum and yttrium in accordance with this invention provide substantially improved oxidation resistance as compared with similar alloys having stoichiometrically equivalent amounts of lanthanum alone or yttrium alone, or containing no added reactive elements at all.

The comparative Larson-Miller stress-rupture tests illustrated graphically in FIG. 1 were conducted on machined specimens cast of single crystals from two different alloys in accordance with the invention (represented by curves "A" and "B"), and from a René N-5 alloy (represented by curve "C"). The results suggest that the alloys of the invention provide single crystal castings that may be operated at higher temperatures and for longer periods of time. For example, the data presented in FIG. 1 suggests that a gas turbine blade cast from an alloy in accordance with the invention may be operated for the same period of time as a similar component cast from the Rene N-5 alloy, but at a temperature of about 50° F. higher than the René N-5 component. Such improvement implies a very substantial improvement in fuel efficiency and economy, providing a smaller carbon footprint and a positive effect on the environment.

Figure 3:
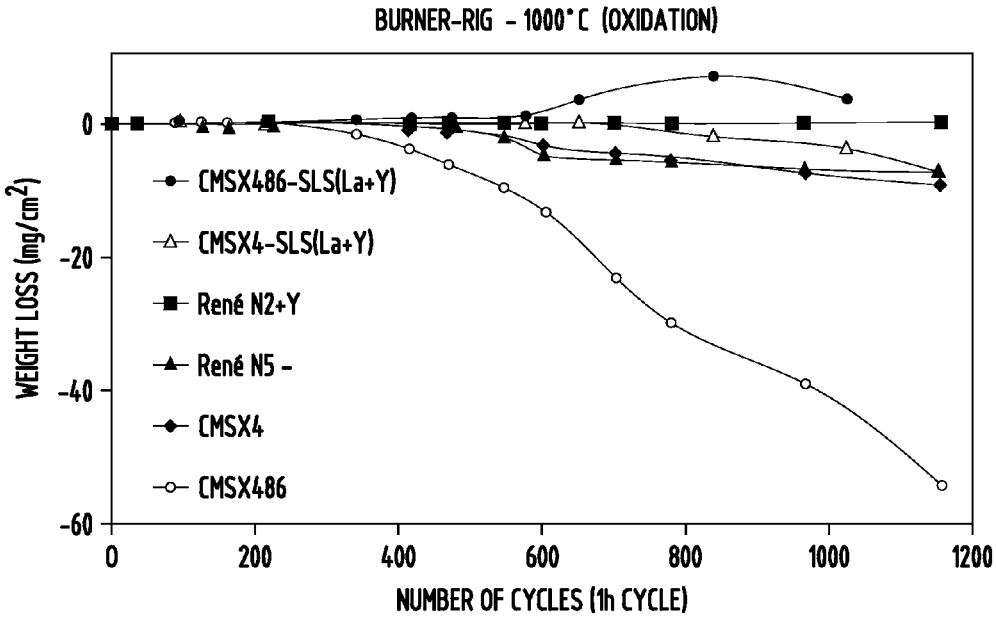
FIG. 3 is a graph of comparative oxidation testing at 1000° C. for various single crystal nickel-based superalloy castings showing weight loss as a function of thermal cycling.

FIG. 3 shows that an alloy in accordance with the invention exhibits an oxidation resistance, as determined by weight loss as a function of thermal cycling, that is equivalent to the René N-5 alloy at 1000° C. and that is substantially superior to the casting from previously known and commercially available CMSX-4® alloy.

Figure 4:
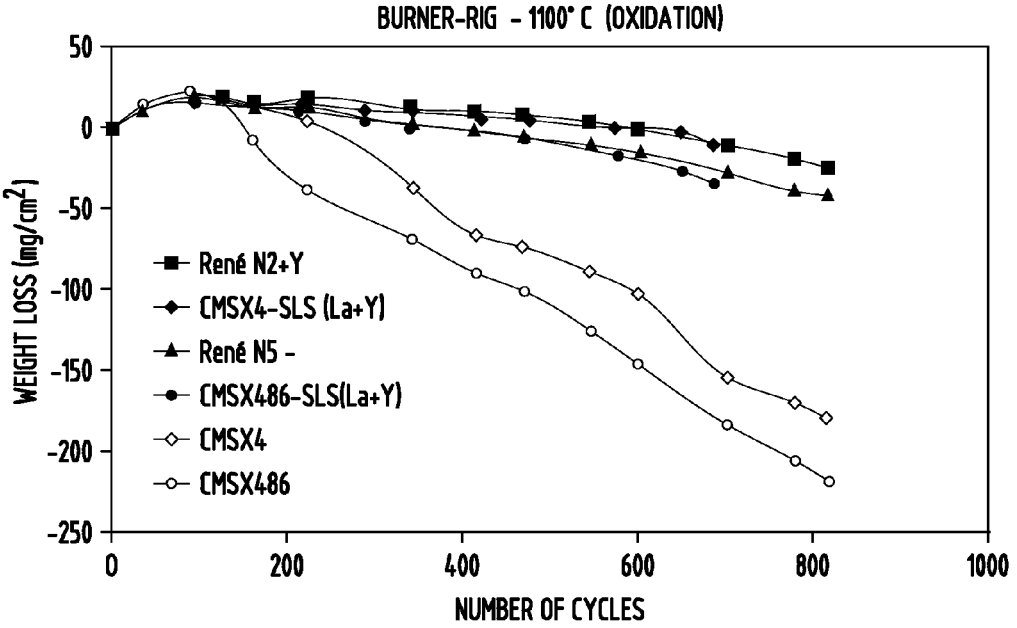
FIG. 4 is a graph of comparative oxidation testing at 1100° C. for various single crystal nickel-based superalloy castings showing weight loss as a function of thermal cycling.

FIG. 4 shows similar improvements in oxidation resistance as compared with conventional CMSX-4® alloy castings at a temperature of 1100° C.

Figure 5:
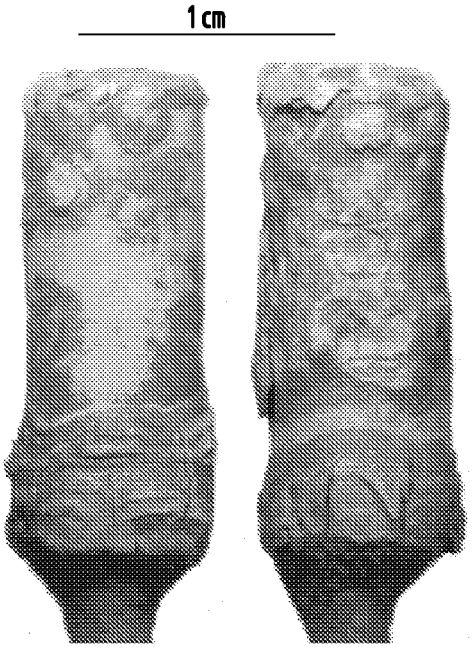
FIG. 5 is a photograph of previously known alloy castings subjected to hot corrosion testing.

FIG. 5 is a photograph of machined test specimens from single crystal castings of a previously known CMSX-4® alloy (that is not in accordance with the invention) and a René N-5 alloy after being subjected to hot corrosion testing at 900° C. for 329 cycles.

Figure 6:
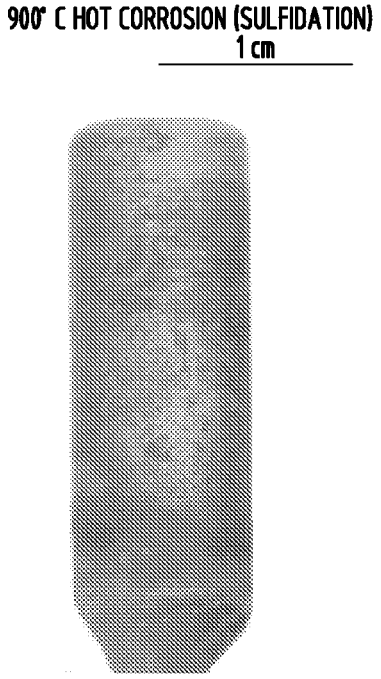
FIG. 6 is a photograph of an alloy casting in accordance with the invention subjected to hot corrosion testing.

FIG. 6 is a photograph of a machined test specimen from a single crystal casting of an improved CMSX-4® alloy in accordance with the invention after being subjected to hot corrosion testing at 900° C. for 244 cycles. Although there is a difference in the number of cycles for the specimens, it is apparent from a comparison of the photograph of FIG. 5 to the photograph of FIG. 4 that the improved alloy of this invention exhibits substantially better hot corrosion resistance than previously known alloys that are widely used in high performance gas turbine applications. The improvement in hot corrosion resistance is especially important for extending the service life of gas turbine engine components used on naval aircraft and other aircraft operated near the ocean.

Figure 7:
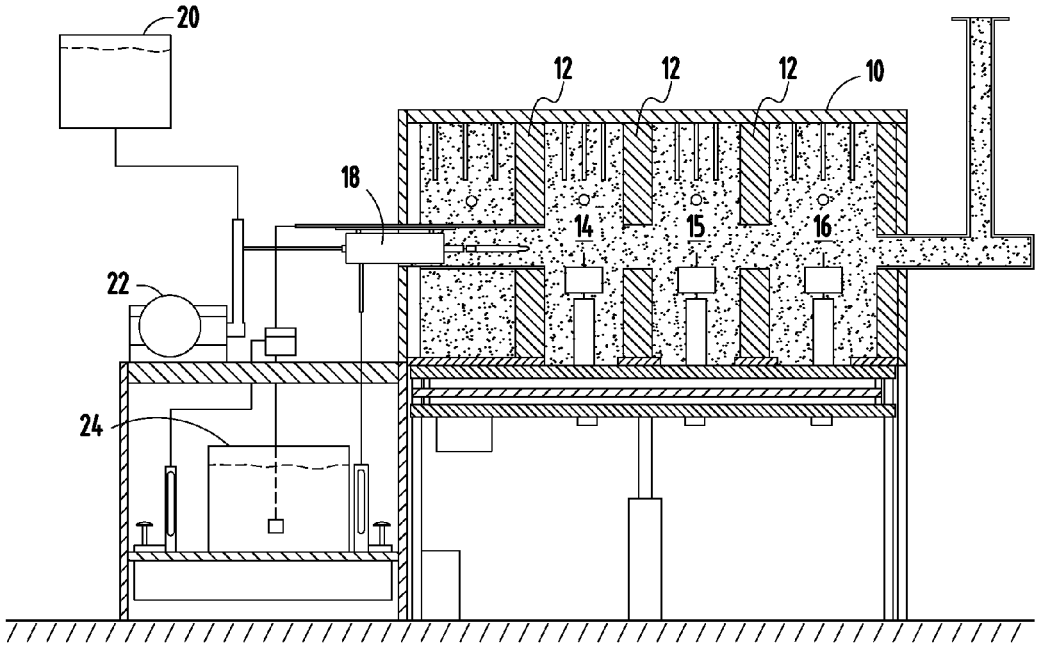
FIG. 7 is a schematic illustration of a three zone burner rig used for testing alloy casting specimens to generate the data illustrated in FIGS. 3 and 4.

FIG. 7 schematically illustrates a burner rig used for subjecting specimens to thermal cycling in order to generate the data shown in FIGS. 3 and 4. The burner rig includes a test chamber 10 having partitions 12 that define test zones 14, 15 and 16, which are each at different temperatures. A burner 18 is used to combust kerosene that is conveyed to burner 18 from a kerosene reservoir 20 by pump 22. In order to simulate aggressive operating conditions that promote corrosion, osmosis water having a sodium chloride concentration of one gram per liter is introduced into burner 18 from reservoir 24 at a predetermined rate for the hot corrosion testing, but not for the oxidation testing.

Figure 8:
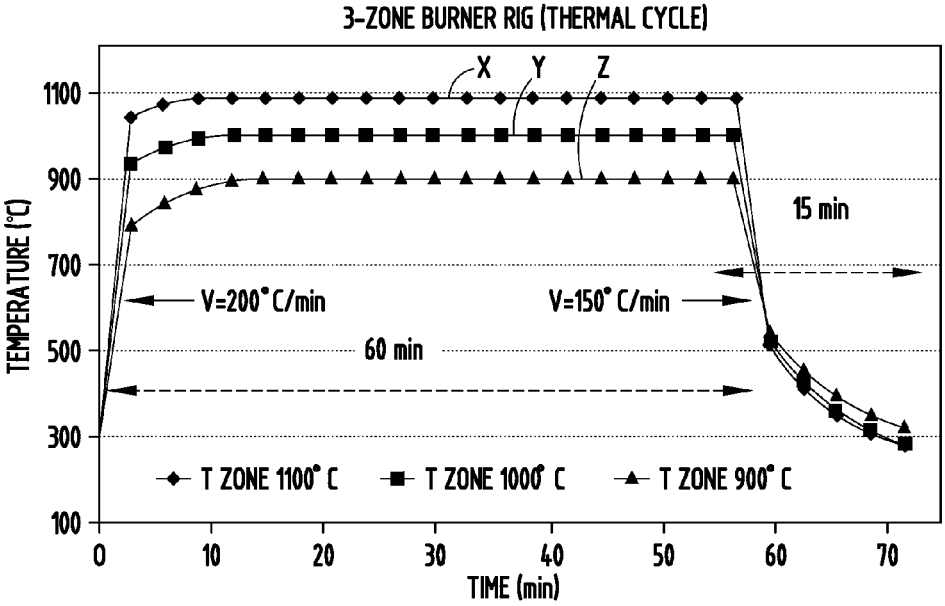
FIG. 8 is a graph showing temperature as a function of time in each of the three test zones of the burner rig during one cycle.

FIG. 8 shows the temperature as a function of time for a thermal cycle in each of the three test zones. Curves "X", "Y", and "Z" represent, respectively, the temperature as function of time for test zones 14, 15, and 16. Test zone 15 (curve "Y") was used for generating the data illustrated in FIG. 3, and test zone 14 (curve "X") was used for generating the data shown in FIG. 4.

Figure 9:
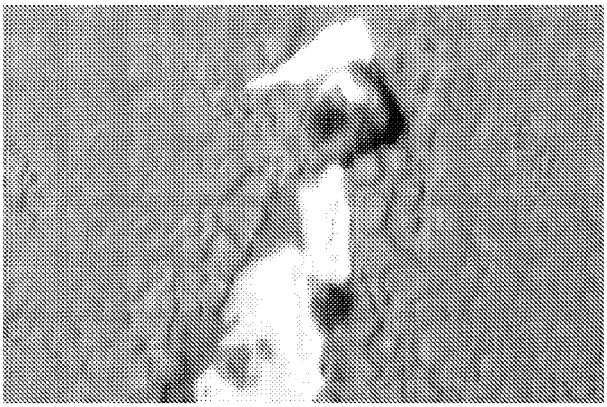
FIG. 9 is a scanning electron micrograph (SEM) of a nickel-base superalloy casting containing a phase region containing sulfides and phosphides.
Figure 10:
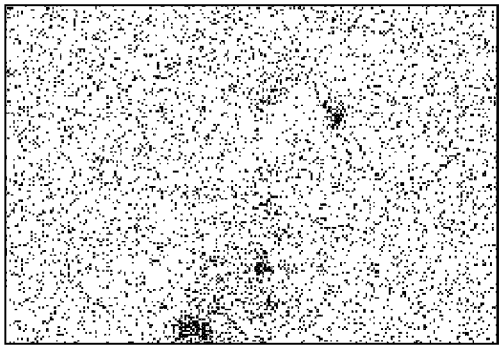
FIG. 10 is a scanning electron micrograph dot map for the same area shown in the SEM of FIG. 9 for phosphorous.
Figure 11:
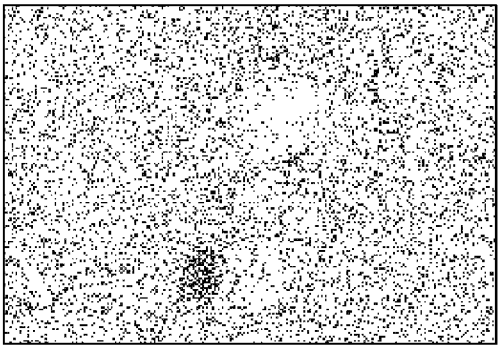
FIG. 11 is a scanning electron micrograph dot map for the same area shown in the SEM of FIG. 9 for sulfur.
Figure 12:
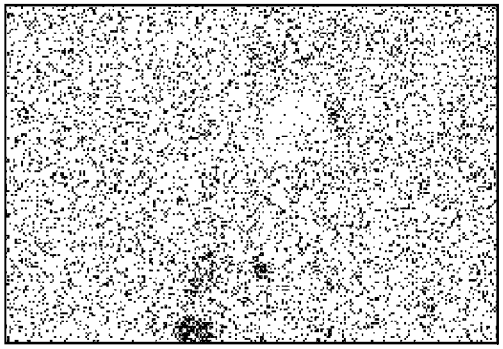
FIG. 12 is a scanning electron micrograph dot map for the same area shown in the SEM of FIG. 9 for yttrium.
Figure 13:
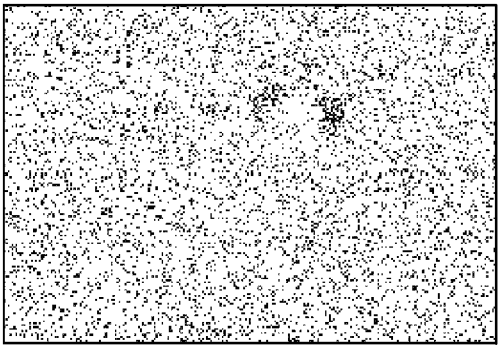
FIG. 13 is a scanning electron micrograph dot map for the same area shown in the SEM of FIG. 9 for lanthanum.

FIGS. 9-13 are scanning electron micrographs of the surface of a single crystal casting from a nickel-based super alloy (similar to the alloy of the invention) having lanthanum and yttrium additions in amounts that are in accordance with this invention. The alloy shown in the micrographs at FIGS. 9-13 contains about 1 ppm sulfur and about 15 ppm phosphorus by weight. Shown in FIG. 9 is an SEM having a phase region containing sulfides and phosphides that were formed by reactions of residual sulfur and phosphorus with lanthanum and/or yttrium. The micrographs of FIGS. 10-13 show phosphorous, sulfur, yttrium and lanthanum as the lightly colored regions, respectively. A comparison of the locations of the lightly colored regions in each of the micrographs informs the person having ordinary skill in the art that lanthanum and/or yttrium have reacted with the phosphorous and sulfur to form stable, innocuous sulfides and phosphides. A similar effect occurs with the alloys of this invention, resulting in improved resistance to oxidation and hot corrosion (sulfidation).

In combination, the data presented herein demonstrates that surprising and unpredictable improvements in oxidation resistance and hot corrosion resistance can be achieved concurrently by carefully controlling sulfur, phosphorus, lanthanum, and yttrium levels in a nickel-based superalloy used for single crystal casting. Very low nitrogen and oxygen levels give reduced grain defects in single crystal castings and substantially lower component cost through increased casting yield. Phosphorus can be picked-up through the single crystal casting process from remelt crucible, shell and ceramic core refractories.

Figure 14:
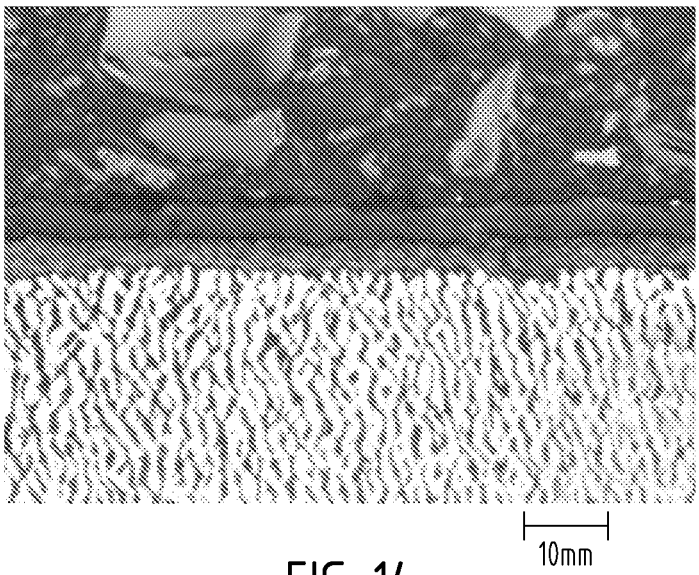
FIG. 14 is a micrograph showing the surface of an alloy in accordance with the invention after 1389 hours of testing at 1050° C. and 125 MPa.
Figure 15:
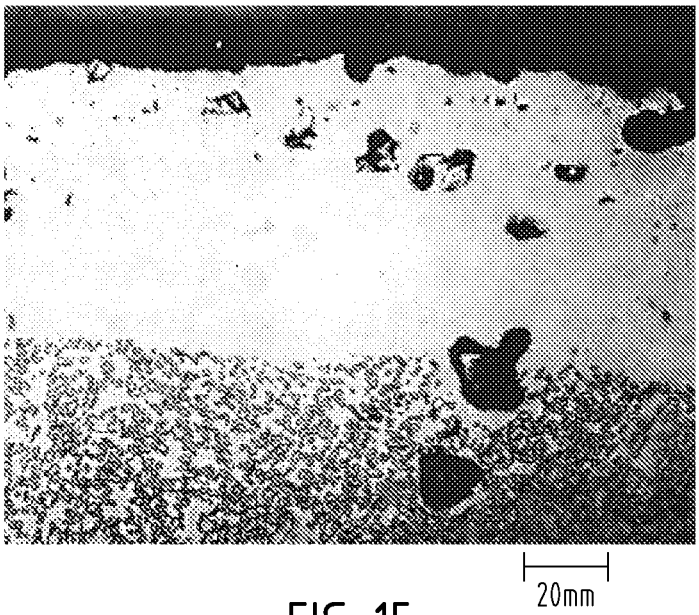
FIG. 15 is a micrograph showing the surface microstructure of a conventional alloy having a similar base composition to the invention, but without the combination of improvements relating to S, P and La and/or Y.

The improved cyclic oxidation behaviors (e.g., oxidative resistance) of the improved alloy of this invention are further illustrated in FIGS. 14 and 15, which are photomicrographs comparing the surface microstructure of an alloy in accordance with the invention (FIG. 14) with a conventional CMSX-4® alloy (FIG. 15). The alloy in accordance with this invention exhibits no gamma prime phase depletion after 1389 hours of testing at 1050° C. and 125 MPa (1922° F./18 ksi), whereas the conventional alloy (which is essentially the same base alloy without the required concentration limits for S and P and without the required Y and/or La addition(s)), shows substantial gamma prime phase depletion in a 94 μm thick layer after only 450 hours of dynamic oxidation testing at 1177° C. (2150° F.).

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A single crystal casting of a nickel-based superalloy composition comprising the following elements expressed as a percentage or ppm by weight of the casting:

| | |
|---|---|
| Co | 9.3-10.0 |
| Cr | 6.4-6.6 |
| Mo | 0.5-0.7 |
| W | 6.2-6.6 |
| Ta | 6.3-6.7 |
| Al | 5.45-5.75 |

-continued

| | |
|---|---|
| Ti | 0.8-1.2 |
| Hf | 0.07-0.12 |
| Re | 2.8-3.2 |
| Ni | BAL |
| S | 0.5 ppm max |
| P | 20 ppm max |
| Y + La | 5-80 ppm |
| residual nitrogen | 3 ppm max |
| residual oxygen | 3 ppm max |
| C | 100 ppm max |
| B | 25 ppm max |
| Zr | 120 ppm max |
| Si | 400 ppm max |
| Fe | 0.15 max. |

2. A single crystal casting of a nickel-based superalloy composition comprising a maximum sulfur content of 0.5 ppm by weight, a maximum phosphorus content of 20 ppm by weight, a maximum nitrogen content of 3 ppm by weight, a maximum oxygen content of 3 ppm by weight, and a combined yttrium and lanthanum content of 5-80 ppm by weight.

3. The casting of claim 2, having a maximum carbon content of 100 ppm by weight and a maximum zirconium content of 120 ppm by weight.

4. The casting of claim 3, having a tungsten content of 6.2-6.6 percent by weight, a rhenium content of 2.8-3.2 percent by weight, a chromium content of 6.4-6.6 percent by weight and a tantalum content of 6.3-6.7 percent by weight.

5. A casting according to claim 1, which exhibits improved oxidation resistance and improved hot corrosion resistance as compared with a CMSX-4 casting.

* * * * *

UNITED STATES PATENT AND TRADEMARK OFFICE

CERTIFICATE OF CORRECTION

PATENT NO. : 9,150,944 B2
APPLICATION NO. : 12/851111
DATED : October 6, 2015
INVENTOR(S) : Kenneth Harris It is certified that error appears in the above-identified patent and that said Letters Patent is hereby corrected as shown below:

In the claims
Column 6, line 62 (Claim 1 – chart) Cr 6.4-6.6
Should be --6.2-6.6--

Signed and Sealed this
Seventeenth Day of November, 2015

Michelle K. Lee

Michelle K. Lee
*Director of the United States Patent and Trademark Office*